United States Patent [19]

Asdigian

[11] 4,412,912

[45] Nov. 1, 1983

[54] HYDROCARBON TREATING PROCESS HAVING MINIMUM GASEOUS EFFLUENT

[75] Inventor: George Asdigian, Arlington Heights, Ill.

[73] Assignee: UOP Inc., Des Plaines, Ill.

[21] Appl. No.: 471,116

[22] Filed: Mar. 1, 1983

[51] Int. Cl.[3] ..... C10G 19/02

[52] U.S. Cl. ..... 208/206; 208/207

[58] Field of Search ..... 208/206, 207

[56] References Cited

U.S. PATENT DOCUMENTS

| | | | |
|---|---|---|---|
| 2,882,224 | 4/1959 | Gleim et al. | 208/206 |
| 2,921,020 | 1/1960 | Urban et al. | 208/205 |
| 2,976,229 | 3/1961 | Brown et al. | 208/2 |
| 3,409,543 | 11/1968 | Urban et al. | 208/234 |
| 3,413,215 | 11/1968 | Beshears | 208/206 |
| 3,574,093 | 4/1971 | Strong | 208/206 |
| 4,081,354 | 3/1978 | Christman | 208/206 |

OTHER PUBLICATIONS

Hydrocarbon Processing, Apr. 1982, p. 124.

Hydrocarbon Processing, Sep. 1968, p. 224.

*Primary Examiner*—Delbert E. Gantz
*Assistant Examiner*—Cynthia A. Prezlock
*Attorney, Agent, or Firm*—James R. Hoatson, Jr.; John F. Spears, Jr.; William H. Page, II

[57] ABSTRACT

A process is disclosed for treating hydrocarbon streams for the purpose of removing mercaptans and also converting the remaining mercaptans to disulfides which remain in the hydrocarbon stream being treated. The hydrocarbons rise through a contacting column countercurrently to a descending stream of an aqueous alkaline solution. A limited amount of an oxygen-containing gas is passed into an intermediate point in the column thereby dividing it into an upper sweetening section and a lower extraction section. The flow rate of the oxygen-containing stream is preferably low enough that any gas not consumed in the catalytic oxidation of mercaptans becomes dissolved in the hydrocarbon product stream, and preferably remains dissolved at atmospheric pressure.

18 Claims, 1 Drawing Figure

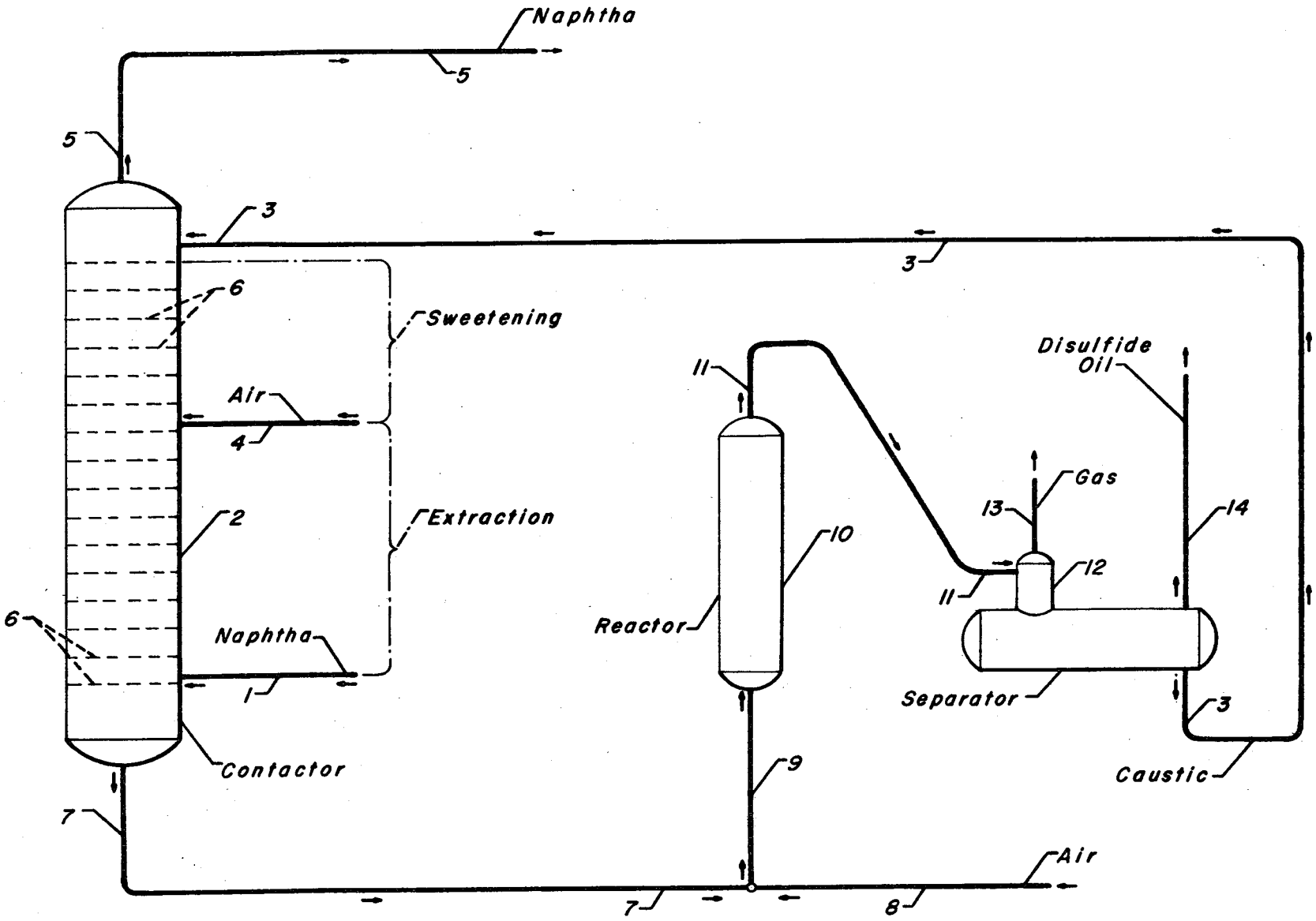
Naphtha
5
Sweetening
Extraction
3
6
Air
4
2
Naphtha
1
Contactor
5
6
7
3
Reactor
10
11
9
7
Separator
12
13
11
Gas
Disulfide Oil
14
3
Caustic
Air
8

HYDROCARBON TREATING PROCESS HAVING MINIMUM GASEOUS EFFLUENT

FIELD OF THE INVENTION

The invention relates to a process for treating mineral oils such as the treating processes performed in petroleum refineries to remove contaminants from LPG or naphtha streams. The invention specifically relates to the treatment of mercaptan-containing hydrocarbon streams for the purpose of removing the mercaptans or converting the mercaptans to disulfides. The invention is directly concerned with such treating processes in which an aqueous caustic stream is used to extract the mercaptans from the hydrocarbon stream either to remove the mercaptans or as an intermediate step in the oxidation of the mercaptans, thereby forming disulfides which become dissolved in the hydrocarbon phase. The latter treating method, which does not reduce the sulfur content of the hydrocarbon stream, is referred to in the petroleum refining arts as sweetening.

PRIOR ART

Both the extraction of mercaptans from hydrocarbons through the use of an alkaline solution and the sweetening of hydrocarbons by the catalyzed oxidation of mercaptans are well known processes. These processes are widely employed on a large scale in petroleum refineries. In the extraction process, the alkaline solution is regenerated by the oxidation of the dissolved mercaptans to disulfide compounds, which are then separated from the aqueous solution by decantation. These processes are described in U.S. Pat. Nos. 2,882,224 and 2,921,020. The former reference is also pertinent for its teaching that the sweetening operation may be performed in a countercurrent contacting process. Several forms of this treating process are also shown at page 124 of the April, 1982 edition of *Hydrocarbon Processing.*

It is also well known that both extraction and sweetening treating steps may be employed in the same process. For instance, the sequential extraction and sweetening of a sour gasoline is shown at page 224 of the September, 1968 issue of *Hydrocarbon Processing.* Treating processes which employ both extraction and sweetening steps and in which an alkaline solution is employed and catalytically regenerated by mercaptan oxidation are shown in U.S. Pat. Nos. 3,409,543 and 3,574,093. These patents are also pertinent for their general teaching as to operating practices, process conditions and feedstocks for both sweetening and mercaptan extraction/oxidation operations. It is believed that heretofore sequential extraction and sweetening steps were performed in separate zones, and that the same aqueous alkaline solution was not transferred directly from a sweetening step to an extraction step.

BRIEF SUMMARY OF THE INVENTION

The subject process reduces the capital costs of sweetening and mercaptan extracting of hydrocarbon feed streams. The process also greatly reduces or eliminates the discharge of a hydrocarbon-containing vapor stream from a sweetening operation, thereby producing a corresponding reduction in product recovery and pollution control operating problems of conventional sweetening operations.

A broad embodiment of the invention may be characterized as a process for treating hydrocarbons which comprises the steps of countercurrently contacting a liquid-phase alkaline aqueous stream and a liquid-phase feed stream comprising mercaptans and hydrocarbons having boiling points under about 650° F. along the height of a unitary vertical contacting zone; and injecting an oxygen-containing stream into an intermediate point in the contacting zone, with the added oxygen reacting with mercaptans which still remain in the hydrocarbon-containing stream in the presence of a mercaptan oxidation catalyst, and thereby effecting a sweetening treatment of the feed stream above the point at which the oxygen-containing stream enters the contacting zone and a mercaptan extraction treatment below the point at which the oxygen-containing stream enters the contacting column.

BRIEF DESCRIPTION OF THE DRAWING

The drawing is a simplified flow diagram of a preferred embodiment of the invention. Numerous pieces of process equipment normally employed in such a process, including vessel internals, pumps, control systems, etc., have not been shown as they do not directly relate to the inventive concept. This illustration of one embodiment of the drawing is not intended to preclude from the scope of the subject invention those other embodiments set out herein or which result from expected and reasonable modification to those embodiments.

Referring now to the drawing, a feed stream of mercaptan-containing naphtha from line 1 enters the lower portion of an extraction column or contactor 2. The naphtha rises upward through the contacting plates or trays 6 toward the top of the contactor countercurrent to a descending stream of an aqueous alkaline solution normally referred to as caustic. Approximately half way up the contactor, air is passed into the contactor through line 4, with the air becoming dissolved in the naphtha. The naphtha continues upward past the point in the upper portion of the column at which the caustic is added through line 3 and is then removed as a liquid-phase hydrocarbon effluent or product stream through line 5. The naphtha has therefore been first treated by the extraction of mercaptans and then further treated by sweetening in which remaining mercaptans are oxidized to disulfides which remain in the naphtha.

A resultant mercaptan-rich stream of the aqueous alkaline solution is removed from the bottom of the contactor through line 7, admixed with air from line 8 and passed into a reactor 10 used as an oxidation zone through line 9. The rich alkaline solution is regenerated by the oxidation of mercaptans to disulfides, thereby yielding a mixed-phase reactor effluent carried by line 11 to the phase separator 12. The remaining nitrogen and any excess oxygen which are not dissolved in the liquids are removed as an off-gas stream discharged through line 13. The disulfides are preferably allowed to separate from the now mercaptan-lean alkaline solution, with the liquid-phase disulfides then being withdrawn through line 14. The regenerated alkaline solution is then recycled to the contactor through line 3. Alternatively, the disulfides may be allowed to remain in the regenerated alkaline solution. In this instance the disulfides also enter the contactor and then become dissolved in the naphtha of the effluent stream. This alternative does not result in a reduction in the sulfur content of the hydrocarbon (naphtha) stream but does produce a sweetened product stream.

DETAILED DESCRIPTION

Treating processes which act upon the mercaptans present in various petroleum fractions are employed in virtually every petroleum refinery. Two of the most prevalent types of such treating processes are the extraction of the mercaptans from the hydrocarbon fraction using an aqueous alkaline solution, which is normally referred to simply as extraction, and the catalytic oxidation of the mercaptans to disulfides which remain in the hydrocarbon fraction. The latter operation is normally referred to as sweetening since a successful treating process will produce a "doctor sweet" product.

In an extraction treating process, the hydrocarbon fraction is brought into contact with an aqueous alkaline solution under conditions which are effective in promoting the transfer of the mercaptans from the hydrocarbon fraction to the alkaline solution. The resultant mercaptan-rich aqueous solution is then separated from the hydrocarbon fraction and regenerated. Extraction therefore decreases the total sulfur content of the hydrocarbon fraction. Extraction is normally used to treat the lighter hydrocarbon fractions, such as LPG, which require a very low total sulfur content to meet various product specifications. As the average molecular weight of the hydrocarbon fraction increases, there is a proportional increase in the difficulty of removing the desired amount of mercaptans via extraction with an aqueous alkaline solution. This is basically due to the fact that the higher molecular weight mercaptans tend to remain in the hydrocarbon phase and do not preferentially transfer to the aqueous phase to the same extent as lower molecular weight mercaptans.

The problems of extracting mercaptans from higher molecular weight hydrocarbon fractions are alleviated by the fact that most product specifications for higher molecular weight petroleum fractions do not preclude the presence of limited amounts of sulfur. However, sulfur in the form of mercaptans is normally objectionable even in these heavier hydrocarbons. It has therefore become a customary practice to convert the mercaptans to disulfides which are allowed to remain in the hydrocarbon stream. Allowing these sulfur-containing compounds to remain in the hydrocarbon fraction also means that the treating process does not decrease the quantity of the hydrocarbon fraction. Some hydrocarbon fractions may therefore be sufficiently treated by a simple sweetening operation. In other instances, as for example when the hydrocarbon fraction contains a very significant amount of mercaptans, it is necessary to employ a two-step treating process in which the hydrocarbon fraction is first treated by extraction and is then further treated in a sweetening step. The extraction removes the majority of the mercaptans originally present in the feed hydrocarbon fraction and the sweetening step converts the remaining mercaptans to disulfides.

Although sweetening is widely employed in a highly successful manner, the present higher economic value of hydrocarbons combined with more stringent pollution control regulations has resulted in the occasional occurrence of a significant operational problem. More specifically, when it is desired to sweeten a relatively volatile hydrocarbon fraction containing a relatively high amount of mercaptans, the removal or recovery of the hydrocarbons present in the off-gas of the sweetening operation can pose a significant economic burden on an otherwise relatively inexpensive treating process. More specifically, when it is attempted to sweeten a high mercaptan hydrocarbon such as a naphtha, the quantity of oxygen required for the oxidation of the mercaptans to disulfides exceeds the solubility limits of the oxygen in the hydrogen fraction. Since an excess of oxygen above the stoichiometrically required amount is normally admixed into the hydrocarbon, some of this oxygen will remain after the sweetening step and is removed as an off-gas of the sweetening step. As the most economical source of oxygen is air, a much larger quantity of nitrogen than oxygen is charged to the sweetening zone during the sweetening operation. Since the nitrogen is not consumed in any way during the oxidation of the mercaptans, all the nitrogen present in the air stream except for that which becomes dissolved in the hydrocarbon must also be vented from the sweetening zone as part of the off-gas stream. This off-gas stream will contain a near equilibrium concentration of the hydrocarbon fraction being treated. The recovery of these hydrocarbons from the off-gas stream through the use of such means as cryogenic separation or absorption places a heavy economic burden on the treating process. These hydrocarbon recovery operations normally require extensive capital expenditures and may entail operational systems more complicated than the entire treating and alkaline reagent regeneration steps combined. It is therefore an objective of the subject invention to provide an improved hydrocarbon treating process in which mercaptans are oxidized to disulfide compounds which remain in the hydrocarbon streams being treated. It is a further objective of the subject invention to reduce or eliminated gases discharged from the sweetening zone of a hydrocarbon treating process.

The subject process may be applied to a wide variety of feed hydrocarbons. It may therefore be applied to essentially any hydrocarbon which may be treated by sweetening. Treating processes are normally restricted to application to those hydrocarbon streams having boiling point ranges which fall below 650° F. More preferably the feed stream to the subject process comprises a mixture of hydrocarbons having boiling points below about 430° F., with these boiling point ranges being determined by the appropriate ASTM test method. The feed stream to the process may contain low molecular weight hydrocarbons down to and including propane and may therefore comprise a mixture of $C_3$ to $C_8$ hydrocarbons. The preferred feed to the subject process is a naphtha stream. Examples of the preferred type of feed hydrocarbon stream therefore include FCC gasolines, light straight run gasolines and light coker naphthas. The subject process is especially suited for treating hydrocarbons having a relatively high Reid vapor pressure. The feed stream therefore preferably has a Reid vapor pressure above 8 pounds. The feed also preferably has a mercaptan content over 50 ppm and more preferably over 350 ppm.

In the subject process, the feed stream is charged to the lower portion of a unitary contactor. The feed stream will normally enter the contactor a short distance above the bottom of the contactor to thereby provide a settling or separation zone in the bottom of the contactor to allow the separation of entrained hydrocarbon from the mercaptan-containing aqueous stream withdrawn at the bottom of the contactor. The contactor is preferably a single vertical vessel containing a sizable number of liquid-liquid contacting trays which may be of customary design. Such trays are sometimes referred to in the art as jet decks. Although the use of a single vessel contactor is highly preferred, the use of a contacting zone comprising two or more vertically stacked separate vessels is possible. Another potential variation in the structure of the contacting zone or contactor is the substitution of a packing material for the preferred liquid-liquid trays. The contactor or contacting zone is divided into a lower extraction section and an upper sweetening section at an intermediate locus at which an oxygen-containing stream is charged to the contactor. It is preferred that both the extraction section and the sweetening section contain a sufficient number of liquid-liquid contacting trays or packing material to provide at least two theoretical extraction units in each section. More specifically it is preferred that at least four actual contacting trays are provided above the intermediate point at which the oxygen-containing gas stream enters the actuator and at least four contacting trays are provided below this intermediate point.

In the subject process, an oxygen-containing stream entering at an intermediate point in the contacting zone supplies the oxygen consumed in the sweetening section of the contacting zone. This oxygen-containing stream could possibly be a liquid phase stream, but it is highly preferred that a gaseous stream is employed in the process. It is also highly preferred that the oxygen-containing stream is a stream of air, although oxygen-enriched air or pure oxygen could be employed if so desired. It is also highly preferred that the total amount of gas present in the oxygen-containing stream becomes dissolved in the total liquids present in the contacting zone. Specifically it is preferred that the rate of addition of all the gaseous compounds present in the oxygen-containing stream is limited to a quantity which is below the remaining gas solubility capacity of the feed hydrocarbon stream. This solubility limit will vary depending on such factors as the composition of the feed hydrocarbon, the temperature of the feed hydrocarbon as it passes through the sweetening section of the contacting zone, the pressure at which the process is being operated, etc. It is very highly preferred that the rate of gas addition is low enough that no significant amount of the remaining added gas(es) will be released when the product hydrocarbon is stored at atmospheric pressure. Therefore in the preferred embodiments of the process, the hydrocarbons rising above the sweetening section of the contacting zone enter a liquid-liquid phase separation zone located in the upper part of the contacting zone and are then removed as a totally liquid phase stream from the top of the contacting zone. Ideally, no vaporous material will accumulate in the upper portion of the contacting zone or be removed in admixture with the treated product stream. However as a safety precaution and to allow for temporary misoperation or process upsets, the hydrocarbon effluent stream could be routed through a vapor-liquid separation zone designed to trap any vaporous material emerging with the hydrocarbon effluent stream. When such a separation zone would be employed, there would normally be no flow of gaseous material from the separator. The treated hydrocarbon effluent stream may be passed through the customary finishing steps such as sand filters, etc.

One embodiment of the subject process may be broadly characterized as a process for treating hydrocarbons which comprises the steps of passing a liquid feed stream comprising hydrocarbons having boiling points below about 600° F. and mercaptans into a lower portion of a unitary contacting column, with the feed stream rising upward through the column; passing a stream of an aqueous alkaline solution into an upper portion of the column, with the aqueous alkaline solution passing downward through the column countercurrent to rising hydrocarbons; passing a first oxygen-containing gas stream into an intermediate point of the column, with oxygen from the gas stream reacting with mercaptans in the presence of a mercaptan oxidation catalyst; removing a hydrocarbon effluent stream comprising disulfide compounds from an upper point in the column above the level at which the stream of aqueous alkaline solution is passed into the column; and removing a stream of an aqueous alkaline solution comprising extracted mercaptans from a lower point in the column below the level at which the gas stream is passed into the column.

Since it is preferred to avoid having vapor present in the hydrocarbon effluent stream, the amount of sweetening which may be performed in the upper or sweetening section of the contactor is limited by the solubility of the residual gases in the hydrocarbon stream. Therefore, unless pure oxygen is employed and totally reacted within the sweetening zone, a condition which is not achieved in commercial operation, only a limited mercaptan concentration may be converted to disulfides in the sweetening zone. The remaining portion of the mercaptans present in the feed stream must be removed through the extraction treating step performed below the sweetening zone. The flow rate of the alkaline solution must therefore be sufficient to remove that quantity of the entering mercaptans which cannot be treated in the sweetening zone. The amount of alkaline solution circulated through the extraction section may exceed that of the sweetening section. For instance, a portion of the alkaline solution withdrawn from the bottom of the contactor (via line 7) may be returned at a point below the entrance of the air stream.

The extracted mercaptans enter the aqueous alkaline solution and are then subsequently converted to disulfides in a manner similar to the known regeneration techniques commercially employed for this purpose. A process flow similar to that illustrated in the drawing is preferably employed for this purpose. In this regeneration procedure, the mercaptan-containing aqueous alkaline solution is admixed with air and passed through a reactor or oxidizer which may contain a fixed bed of mercaptan oxidation catalyst. Alternatively, the mercaptan oxidation catalyst which is dissolved in the aqueous alkaline solution for the purpose of promoting the mercaptan oxidation which occurs in the sweetening section may be the sole means of oxidation catalysis employed in the reactor. When correctly performed, this oxidative regeneration results in the production of a mixed phase effluent which is passed into a separator. The residual nitrogen which remains from the air stream used to supply oxygen along with residual oxygen is removed as a gas stream from the separator. Since the feed hydrocarbons are not present in this separator, this gas stream will not contain the feed hydrocarbons and will contain only a very limited amount of disulfides. The disulfides have a limited solubility in the aqueous alkaline solution normally employed in the process and may therefore be separated by decantation as a less dense "hydrocarbon phase" which is commonly referred to as a disulfide oil. In an alternative embodiment of the subject process, the disulfides are not separated from the aqueous alkaline solution but are returned to the top of the contactor as part of the alkaline solution. The disulfides are normally soluble in the feed hydrocarbons and will therefore be extracted from the alkaline solution by the hydrocarbon stream being treated. This will transfer the disulfides to the hydrocarbon stream and they are then removed as a component of the hydrocarbon effluent stream of the contactor. This alternative embodiment results in the hydrocarbon effluent stream having a total sulfur content close to that of the feed stream. However, the product stream is "sweet" and will meet product specifications calling for a sweet product.

The subject extraction process may utilize in the alkaline solution any alkaline reagent which is capable of extracting mercaptans from the feed stream at practical operating conditions and which may be regenerated in the manner described. A preferred alkaline reagent comprises an aqueous solution of an alkaline metal hydroxide, such as sodium hydroxide or potassium hydroxide. Sodium hydroxide, commonly referred to as caustic, may be used in concentrations of from 1 to 50 wt.%, with a preferred concentration range being from about 5 to about 25 wt.%. Optionally, there may be added an agent to increase the solubility of the mercaptans in the alkaline solution.

The conditions employed in the contacting zone may vary greatly depending on such factors as the nature of the hydrocarbon stream being treated and its mercaptan content, etc. In general, both extraction and sweetening may be performed at an ambient temperature above about 60° F. and at a pressure sufficient to ensure liquid state operation. The operating pressure may range from atmospheric up to 1000 psig or more, but a pressure in the range of from about 60 to about 350 psig is preferred. The temperature in the contacting zone is normally confined within the range of 50° to about 250° F., preferably from 80° to 120° F. The ratio of the volume of the alkaline solution required in the extraction section per volume of the feed stream will vary depending on the mercaptan content of the feed stream. Normally this ratio will be between 0.01:1 and 1:1, although other ratios may be desirable. The rate of flow of the alkaline solution will typically be about 1 to 10% of the rate of flow of an LPG stream and may be up to about 20% of a light straight run naphtha stream. These rates may be obtained in various ways as set out herein. The extraction section of the contactor preferably contains trays having a large number of circular perforations. Optimum extraction in this liquid system is obtained with a velocity through the perforations of from about 5 to about 10 feet per second. As previously mentioned, packing and other types of extraction equipment could be employed if desired. Preferably at least one-half of the extractable mercaptans should be transferred to the alkaline solution from the feed stream within the extraction section of the contacting zone.

Proper operation of the extraction section results in the formation of a mercaptan-containing alkaline stream which is also referred to as a rich alkaline stream or rich caustic stream. This stream is removed from the contacting zone and then mixed with an air stream supplied at a rate which supplies at least the stoichiometric amount of oxygen necessary to oxidize the mercaptans in the alkaline stream. The air or other oxidizing agent is well admixed with the liquid alkaline stream and the mixed-phase admixture is then passed into the oxidation zone. As already pointed out, the oxidation of the mercaptans is promoted through the presence of a catalytically effective amount of an oxidation catalyst capable of functioning at the conditions found in the reactor or oxidizing zone. Several suitable materials are known in the art. Preferred as a catalyst is a metal phthalocyanine such as cobalt phthalocyanine or vanadium phthalocyanine, etc. Higher catalytic activity may be obtained through the use of a polar derivative of the metal phthalocyanine, especially the monosulfo, disulfo, trisulfo and tetrasulfo derivatives.

The preferred mercaptan oxidation catalysts may be utilized in a form which is soluble or suspended in the alkaline solution or it may be placed on a solid carrier material. If the catalyst is present in the solution, it is preferably cobalt or vanadium phthalocyanine disulfonate at a concentration of from about 5 to 1000 wt. ppm. If the catalyst is present in the alkaline solution, then the same catalyst is employed in both the sweetening section of the contacting zone and in the regeneration of the rich alkaline solution. If supported catalyst is employed, then the same or different catalysts may be used in these two locations. Carrier materials should be highly absorptive and capable of withstanding the alkaline environment. Activated charcoals have been found very suitable for this purpose, and either animal or vegetable charcoals may be used. The carrier material is to be suspended in a fixed bed which provides efficient circulation of the alkaline solution. Preferably the metal phthalocyanine compound comprises about 0.1 to 2.0 wt.% of the final composite. More detailed information on liquid-phase catalysts and their usage may be obtained from U.S. Pat. Nos. 2,853,432 and 2,882,224. Likewise, further information on fixed bed operations is contained in U.S. Pat. Nos. 2,988,500, 3,108,081 and 3,148,156.

The oxidation conditions utilized for regeneration of the rich alkaline solution include a pressure of from atmospheric to about 1000 psig, and preferably are substantially the same as used in the downstream phase separation zone. This pressure is normally less than 75 psig. The temperature may range from ambient to about 200° F. when operating near atmospheric pressure and to about 400° F. when operating at superatmospheric pressures. In general, it is preferred that a temperature within the range of about 100° to about 175° F. is utilized. The reactor or oxidation preferably contains a packed bed to ensure intimate mixing. This is done in all cases, including when the catalyst is circulated within the alkaline solution.

The phase separation zone which receives the regenerated alkaline solution may be of any suitable configuration, with a settler such as represented in the drawing being preferred. A simple gas separation vessel may be employed if all of the liquid material is to be passed into the contacting zone. There is formed in this zone a first liquid phase containing the aqueous alkaline solution and a second liquid phase containing the disulfide compounds. The phase separation zone is sized to allow the denser alkaline solution to separate by gravity from the disulfide compounds. This may be aided by a coalescing means located in the zone. Normally, a residence time in excess of 90 minutes is provided. A stream of a suitable hydrocarbon, such as a naphtha, is in some instances admixed with the material entering the zone to aid in the separation of the two liquid materials. The disulfide compounds and any added hydrocarbons are removed from the process as a by-product stream, and the aqueous alkaline solution is withdrawn for passage into the contacting zone.

It is desirable to run the phase separation zone at the minimum pressure which other design considerations will allow. This is to promote the transfer of the excess oxygen, nitrogen and water into the vapor phase. The pressure in the phase separation zone may range from atmospheric to about 300 psig or more, but a pressure in the range of from about 10 to 50 psig is preferred. The temperature in this zone is confined within the range of from about 50° to about 250° F., and preferably from about 80° to 130° F.

The excess oxygen admixed with the alkaline solution during regeneration results in the presence of unused gaseous oxygen in the phase separation zone. This, along with the nitrogen from the air and some water vapor, is removed as a relatively small vapor stream. The presence of oxygen vapor in any refinery process stream calls for the utmost care in preventing the accidental formation of explosive mixtures by the oxygen-containing stream becoming admixed with hydrocarbons or other combustibles. It is therefore the standard practice to purposely admix this stream with a stream of volatile hydrocarbons having a sufficient flow rate to establish a hydrocarbon concentration above the explosive limit in the resulting mixed gas stream. In this way, any accidental admixture of the separator off-gas stream with hydrocarbons only results in a further enrichment of the stream in hydrocarbons and cannot lead to an explosive mixture. The vapor stream used for this purpose is preferably a fuel gas stream, that is, one which is scheduled for combustion, and the resulting admixture is used as fuel.

Excess water produced in the process may be removed from the alkaline solution by contacting a relatively small portion of the regenerated solution with a vapor stream under conditions which promote the transfer of water into the vapor stream from the alkaline solution. Although other gas streams could be used, it is greatly preferred that the vapor stream used for removing water from the alkaline solution is the same vapor stream which is subsequently admixed with the phase separation zone off-gas stream to increase the hydrocarbon content of that stream. The vapor stream used in the contacting step preferably is rich in volatile hydrocarbons, that is, hydrocarbons having fewer than six carbon atoms per molecule. The relatively small alkaline solution stream and the vapor stream are brought together in a contacting zone which is also referred to as a water balance column. Details on the operation of a water balance column are available in the patent literature such as U.S. Pat. Nos. 4,104,155 and 4,362,614.

Although it is preferred that the mercaptan oxidation catalyst employed in the sweetening section is contained in the aqueous stream, a solid oxidation catalyst can be present in the sweetening section. This is especially true when a packed bed sweetening section is utilized, since the catalyst may form some or all of the packing material. Another variation in the subject process comprises splitting the flow of the aqueous alkaline solution into two portions, with the first portion entering the top of the sweetening section in the manner previously described and with a second portion entering the contacting column at some point within or just above the extraction section. This mode of operation can provide high rates of extraction in the extraction section without requiring high flow rates of the aqueous stream through the sweetening section. Therefore from about 20 to about 80 volume percent of the total amount of the aqueous alkaline solution which is passed into the contacting column may enter the column at an intermediate point just above the extraction section and below the sweetening section.

I claim as my invention:

1. A process for treating hydrocarbons which comprises the steps of:

(a) countercurrently contacting a liquid-phase alkaline aqueous stream and a liquid-phase feed stream comprising mercaptans and hydrocarbons having boiling points under about 650° F. along the height of a vertical contacting zone; and, (b) injecting an oxygen-containing stream into an intermediate point in the contacting zone, with the oxygen reacting with mercaptans in the presence of a mercaptan oxidation catalyst, and thereby effecting a sweetening treatment of the feed stream above the point at which the oxygen-containing stream enters the contacting zone and a mercaptan extraction treatment of the feed stream below the point at which the oxygen-containing stream enters the contacting zone.

2. The process of claim 1 further characterized in that the mercaptan oxidation catalyst comprises a metal phthalocyanine.

3. The process of claim 2 further characterized in that all gas present in the oxygen-containing stream becomes dissolved in the liquid present in the contacting zone.

4. The process of claim 3 further characterized in that the oxygen-containing stream is a gas stream comprising air.

5. The process of claim 2 further characterized in that the mercaptan oxidation catalyst is dissolved in the alkaline aqueous stream.

6. The process of claim 5 further characterized in that the contacting zone is a single column which contains at least four contacting trays above and at least four contacting trays below the intermediate point at which the oxygen-containing stream is passed into the contacting column.

7. The process of claim 4 further characterized in that the feed stream has a Reid vapor pressure above 8 lbs.

8. A process for treating hydrocarbons which comprises the steps of:

(a) passing a liquid feed stream comprising hydrocarbons having boiling points below about 600° F. and mercaptans into a lower portion of a unitary contacting column, with the feed stream rising upward through the column;

(b) passing a stream of an aqueous alkaline solution into an upper portion of the column, with the aqueous alkaline solution passing downward through the column countercurrent to rising hydrocarbons;

(c) passing a first oxygen-containing gas stream into an intermediate point of the column, with oxygen from the gas stream reacting with mercaptans in the presence of a mercaptan oxidation catalyst;

(d) removing hydrocarbon effluent stream comprising disulfide compounds from an upper point in the column; and, (e) removing a stream of an aqueous alkaline solution comprising extracted mercaptans from a lower point in the column below the level at which the gas stream is passed into the column.

9. The process of claim 8 further characterized in that the flow rate of the first oxygen-containing gas stream is such that all of the added gas becomes dissolved in liquids present in the column.

10. The process of claim 9 further characterized in that the oxidation catalyst is dissolved in the aqueous alkaline solution.

11. The process of claim 10 further characterized in that the hydrocarbons of the feed stream have boiling points below about 430° F.

12. The process of claim 11 further characterized in that the oxidation catalyst comprises a metal phthalocyanine.

13. The process of claim 12 further characterized in that the extraction column contains liquid-liquid extraction trays.

14. The process of claim 12 further characterized in that the extraction column contains a solid high surface area packing material.

15. The process of claim 14 further characterized in that the packing material is preferentially wetted by the aqueous alkaline solution.

16. The process of claim 10 further characterized in that the stream of aqueous alkaline solution removed from the column is admixed with a second oxygen-containing gas stream under conditions effective to promote the oxidation of mercaptans in the aqueous alkaline solution to disulfides, and any undissolved gas is then separated from the resultant admixture of disulfides and aqueous alkaline solution.

17. The process of claim 16 further characterized in that the resultant admixture of disulfides and aqueous alkaline solution is passed into the extraction column as said stream of aqueous alkaline solution, with disulfides present in the resultant admixture thereby becoming dissolved in the hydrocarbon effluent stream.

18. The process of claim 9 further characterized in that the feed stream has a mercaptan concentration over 50 ppm.

* * * * *